United States Patent [19]

Price

[11] 3,959,084

[45] May 25, 1976

[54] PROCESS FOR COOLING OF COKE

[75] Inventor: John Gordon Price, Pittsburgh, Pa.

[73] Assignee: Dravo Corporation, Pittsburgh, Pa.

[22] Filed: Sept. 25, 1974

[21] Appl. No.: 509,079

[52] U.S. Cl. ..... 201/39; 202/227; 202/228; 202/95; 202/253; 34/20; 34/168; 34/13

[51] Int. Cl.[2] ..... C10B 39/00

[58] Field of Search ..... 202/227, 228, 229, 230, 202/95, 253; 201/39; 110/31; 266/32; 34/20, 168

[56] References Cited

UNITED STATES PATENTS

| | | | |
|---|---|---|---|
| 3,774,315 | 11/1973 | Schmalfeld et al. | 202/228 X |
| 3,795,987 | 3/1974 | Kemmetmueller | 202/228 UX |
| 3,800,428 | 4/1974 | Ahland et al. | 202/229 X |
| 3,809,619 | 5/1974 | Drebes et al. | 201/39 |
| 3,843,458 | 10/1974 | Kemmetmueller | 202/228 X |
| 3,846,250 | 11/1974 | Knappstein et al. | 201/39 |

*Primary Examiner*—James H. Tayman, Jr.
*Attorney, Agent, or Firm*—Parmelee, Miller, Welsh & Kratz

[57] ABSTRACT

Upon discharge from a coke oven, highly heated coke is cooled by charging the hot coke to a shaft cooler wherein it is contacted with an inert cooling gas to a temperature of between 600°–800°F, the coke then being discharged through a pressure retention device and to a quench bunker by means of a feeding device, with the coke further cooled to a temperature of below 300°F by water sprays, while preventing entrance of steam into the shaft cooler. The feed means and quench bunker are enclosed so as to prevent discharge to the atmosphere of steam produced on contact of the spray with the coke as well as particulate material carried thereby. The coke at below 300°F is then fed to a conveyor for removal from the cooling area.

3 Claims, 2 Drawing Figures

PROCESS FOR COOLING OF COKE

BACKGROUND OF THE INVENTION

When coke is produced in a coke oven, it is progressively removed in batches one after another from a battery of retorts. Each retort yields a large incandescent mass that is pushed from the retort at a temperature of the order of 2000°F. Being a combustible material comprised principally of carbon, it will readily burn if exposed to the air. Consequently, it must be protected from burning and cooled below an ignition temperature.

Generally, this has been done by quenching it with large quantities of water with the resulting steam being removed as saturated steam, quenching taking place of course from the outside toward the center of the mass. Water is a highly effective coolant, both because of its considerable specific heat but, more importantly, because of the large amount of latent heat, or heat of vaporization, which is required to convert water from a liquid to a gaseous state. However, contacting the incandescent coke with quantities of water results in the conversion of water to steam with explosive rapidity, resulting in fragmentation of the coke and the production of an undesirable quantity of fines. Both the steam and the fines give rise to pollution problems of such magnitude that the problem of protecting the surrounding air imposes tremendous expense.

Other processes have been perfected for the continuous cooling of coke wherein successive charges are discharged into the top of shaft type cooling units through which inert gas is circulated from the lower end toward the top of the cooler. This inert gas is removed from the upper end of the shaft at high temperature and circulated through a waste heat boiler to generate steam and partially cool the gases, which, however, may then require further cooling in a heat exchange unit of some type to be effectively cooler than the coke in the lower portion of the column. Thereafter, the cooled gases are recirculated to the shaft cooler.

This process requires that the coke be cooled generally to a temperature of around 400°F, that is below a temperature where the coke will burn upon being discharged from the cooler into the atmosphere. The disadvantage of this method, however, is that the cooler the coke becomes, the lower the temperature of the inert gas must be in order to effectively cool it, and, even then, large volumes of inert gas are required to be circulated, adding both to initial plant cost and to subsequent operation.

Attempts to continuously cool with water involve more expensive and different procedures. It is obvious that an attempt to use steam in place of inert gas in a shaft cooler would result in the generation of water gas or producer gas because superheated steam in contact with incandescent carbon in an enclosure results in the dissocation of $H_2O$, resulting then in $CO + H_2$. Hence, after the specific heat and the latent heat cooling effect of water have been used, the steam, unlike inert gas, cannot be used to remove more heat.

According to the present invention, coke is continuously cooled in a shaft cooler where the temperature differential between an inert gas and the coke results in a rapid removal of heat, but, as the coke reaches a temperature of 600°F to 800°F, it is discharged from the lower end of the shaft. It leaves the lower end of the shaft and moves through a chute to a quenching bin, both enclosed. As the coke moves down the chute to the bin, it is sprayed with water. At this lower temperature a relatively small volume of water at perhaps tap water temperature, or even warmer, requiring considerable heat to raise it to the boiling point and its high latent heat factor, or heat of vaporization, somewhere over 900 B.T.U. per pound, will cool the 600° or 800° coke below its ignition temperature. Moreover, the quenching will be far less violent.

An important incidental advantage is that the inert gas need not be cooled to nearly as low a temperature to be effectively recirculated and the volume of inert gas will be reduced.

With this combination, inert gas is used in the area of cooling the coke where it is most advantageous, i.e., where the temperature differentials are the greatest and convective cooling is the most effective while water is used in the range where its cooling capacity, depending as it does primarily on the transfer of heat energy as latent heat, is greatest and the least amount of water is required.

To assure that the coke will be sufficiently cool to be discharged from the quenching bin to the conveyor on which it is carried to a point of storage, more water may be sprayed on it in the quenching bin, this being preferably so regulated that the coke leaving the bin will even feel damp to the touch.

It is, of course, important that the application of water to the coke be effected after its removal from the bottom of the shaft in order to assure that no steam from the quenching will enter the shaft where, mixed with the inert gas, it would react with the high temperature coke, as above described.

BRIEF DESCRIPTION OF THE INVENTION

Highly heated coke, upon removal from a coke oven, is charged to a shaft cooler wherein the coke is partially cooled to a temperature between 600°–800°F by contact with a flow of cool inert gases, the coke then being discharged from the shaft cooler through a pressure retention device for water quenching. The partially cooled coke, at 600°–800°F is water quenched while being fed to a wet quench bunker and while in the bunker to lower the temperature of the coke to below about 300°F, with steam and dust particles from the quenching step being collected and off gases cleaned prior to discharge to the atmosphere. Upon reaching a temperature of about 300°F or below, the coke is fed from the quench bunker to a conveyor for removal of the coke to storage or use facilities. The cooled coke is easily handled by the conveyor in its cooled state and the moisture content of the resulting coke is controlled to give a desired moisture content above that of dry cooled coke.

DETAILED DESCRIPTION

The present invention provides for the use of advantages of both dry cooling and water quenching of coke while still maintaining antipollution practices. Coke is generally produced in ovens in which coal is highly heated and distilled, with such ovens usually placed adjacent each other in a battery. Each oven is charged with coal, fired, and following a predetermined distillation time, the coke produced is discharged from the oven by a coke pusher and into a coke car for cooling. Such cars are now designed with self-contained gas scrubbing systems so as to prevent escape of polluting gases and fumes to the atmosphere and provision is made to transfer the coke from the car to an enclosed skip hoist for charging of the highly heated coke to a shaft cooler for dry cooling of the coke.

Figure 1:
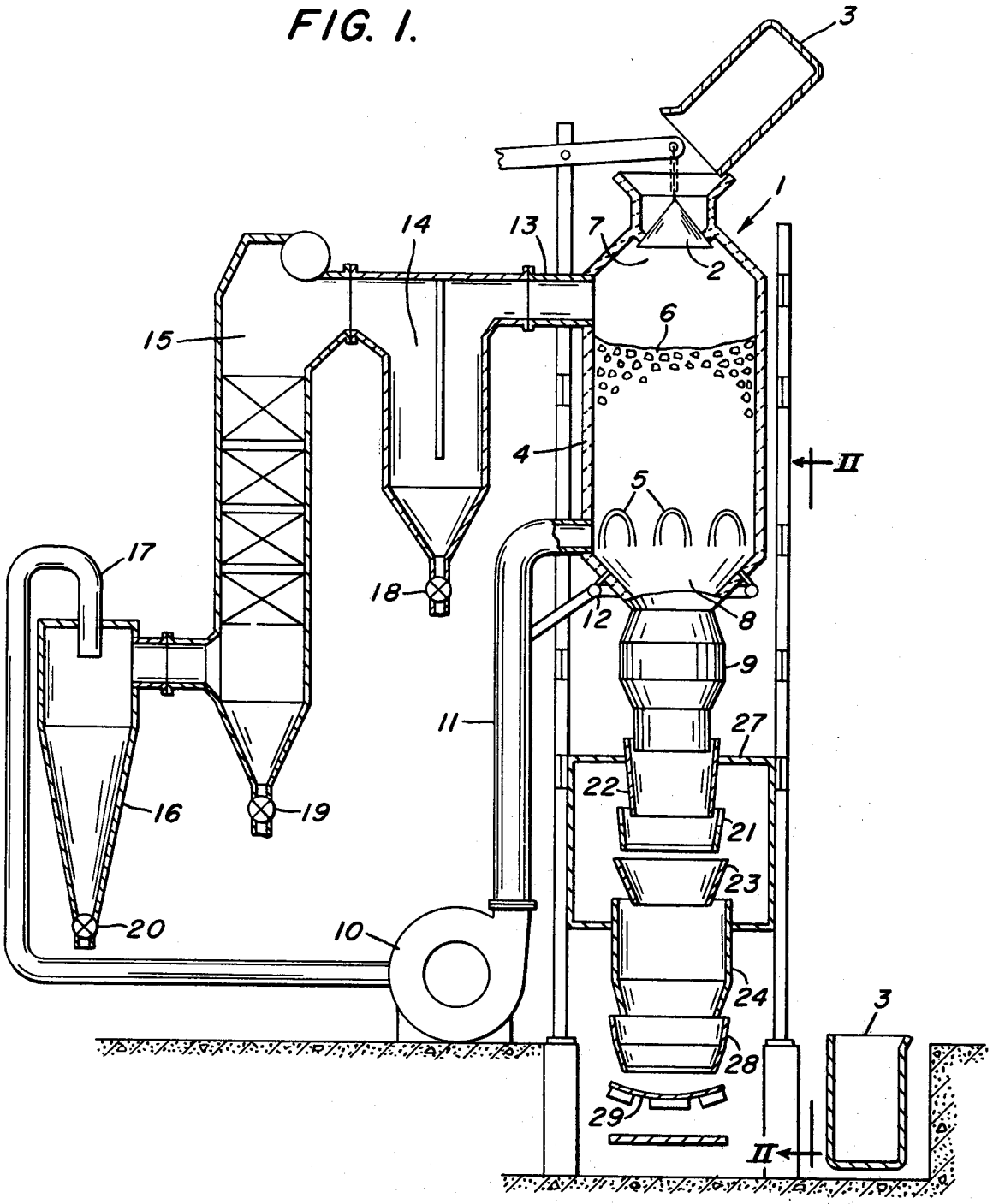
FIG. 1 schematically illustrates the present process and an apparatus for carrying out the process.
Figure 2:
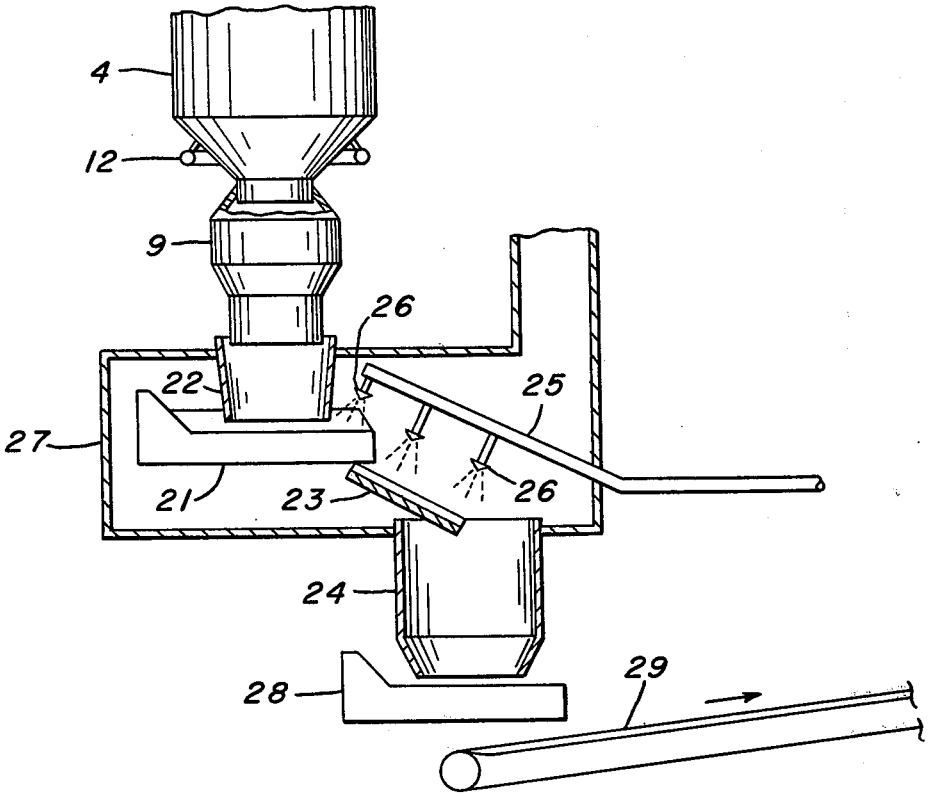
FIG. 2 is a view taken along the lines 2—2 of FIG. 1.

Referring now to FIG. 1, there is illustrated a shaft cooler 1 having a bell 2 or other sealing means and an associated skip 3 for charging highly heated coke to the shaft cooler. The shaft cooler 1, which may be of conventional design, comprises a refractory lined shell 4 having a gas distributor 5 therein through which relatively cooler inert gas is passed and forced upwardly through a charge 6 of hot coke. The shell 4 is closed at its upper or charging end 7 by the bell 2 and at its lower or discharge end 8 by an associated lock hopper 9 having a pressure retaining device. Cool inert gases are fed by a blower 10 through a conduit 11 and through distributor 5 and also, preferably, through tuyere-like feeders 12. The inert gases pass upwardly through the hot coke 6 and, through contact with the coke, are heated while the coke is cooled to the desired temperature. The heated inert gases then are passed through a conduit 13 to a dust catcher 14, and to a boiler 15 or other heat exchange means. In the boiler 15, the heated inert gases are used to produce steam and are then passed through a cyclone 16, and finally in a cooled state, are recycled through conduit 17 to blower 10. Dust catching means 18 on the dust catcher 14, 19 on the boiler 15, and 20 on the cyclone 16, are provided to carry collected dust to a pneumatic dust handling device (not shown). After sufficient contact of the hot coke with the inert gas in the shaft cooler to partially cool the same to a temperature of about 600°–800°F, the partially cooled coke is discharged into the pressure retaining device 9, which device prevents entrance of external air and steam into the shaft cooler 1, the shaft cooler being under some pressure imposed by the forcing of the inert gases through the coke 6. Situated below the pressure retaining device 9 is a vibrating feeder 21 and, optionally intermediate the two, a feed hopper 22 for collecting and metering partially cooled coke to the vibrating feeder 21. The partially cooled coke is fed from the vibrating feeder 21 to a chute 23 which leads the partially cooled coke to a wet quench bunker 24. As illustrated in FIG. 2, positioned adjacent the shaft cooler 1 is a wet spray unit including a conduit 25 to which water is fed, the source of which is not shown in the drawing, and through spray heads 26 which direct a water spray onto the partially cooled coke while the same is carried on the vibrating feeder 21, chute 23, and in the wet quench bunker 24. As illustrated, the feeder 21, chute 23, and wet quench bunker 24 are enclosed within an enclosure 27 so as to prevent escape of steam and dust particles to the atmosphere, such being directed to a stack for cleaning. Below the wet quench bunker 24 there is located a feeder 28 which may also comprise a vibrating feeder which transfers the further cooled coke from the wet quench bunker 24 to a conveyor 29, the conveyor carrying the further cooled coke to a distant area for use or storage.

In operation, highly heated coke from the coke ovens is transferred to a skip 3 and, with bell 2 in open position, with the pressure at the upper region 7 of shaft cooler 1 at approximately atmospheric pressure to preclude entrance of external air to the shaft cooler 1, the highly heated coke is charged to the shaft cooler 1. The coke, normally at a temperature of about 2000°F upon introduction to the shaft cooler, descends within the shaft cooler and is partially cooled by passage therethrough of cool, inert gases. The heated inert gases are passed through the dust catcher 14 and to the boiler unit 15, the temperature being generally in the range of 1400°–1500°F, wherein the heat exchange in producing steam in the boiler cools the gases, with gases being recycled to the shaft furnace 1 at a temperature of about 400°–500°F. The coke, following a predetermined holding period in the shaft furnace to partially cool the same to a temperature between 600°–800°F, is discharged from the shaft cooler to a lock hopper 9 wherein a pressure change is effected so as to subsequently pass the partially cooled coke to feeder 21 through feed hopper 22. On the feeder 21, the partially cooled coke, at 600°–800°F, is sprayed with water from sprayers 26 and the spray of water continued while the coke is passed over chute 23 and while the coke is collected in wet quench bunker 24. The partially cooled coke is thus further cooled by water spraying to a temperature below about 300°F, preferably about 250°F, before it is fed to feeder 28 and finally carried away by conveyor 29. As described hereinbefore, the steam, fumes and dust particles given off by the coke upon quenching are collected by enclosure 27 and this discharge cleaned prior to release to the atmosphere to provide a non-polluting quench. The water spray is preferably adjusted so that the coke, while being drenched in the wet quench bunker 25, will retain moisture on the outside thereof while on conveyor 29, but evaporation caused by the hot interior of the coke pieces will result in a final coke product which will have about 2–3% moisture remaining therein.

I claim:

1. The method of cooling coke from incandescent temperature to a temperature where it may be transported in open air on a conveyor belt which comprises initially reducing the temperature from said incandescent temperature to a range between 600°F and 800°F by inert gas circulating therethrough in a first enclosure and thereafter immediately cooling it in a second enclosure by direct transfer of heat from the coke to water where the latent heat of vaporization of the water as liquid to steam effects the primary reduction of temperature of the coke from the range of 600°F to 800°F to a temperature between about 200°–300°F, below the temperature where steam and hot coke react, and excluding steam so produced from said first enclosure.

2. The method of cooling coke defined in claim 1, wherein partially cooled coke at a temperature between 600°–800°F is continuously charged to the second enclosure for reduction of the temperature thereof to a temperature between about 200°–300°F, below the temperature where steam and hot coke react.

3. The method of cooling coke defined in claim 1, wherein coke is removed from said second enclosure at a temperature between about 200°–300°F and carries residual water therewith such that the coke, when further cooled to ambient temperature, will contain about 2–3% moisture.

* * * * *